United States Patent [19]

Randolph

[11] 4,312,471

[45] Jan. 26, 1982

[54] FOOT POWERED TUFTING MACHINE

[76] Inventor: Arthur J. Randolph, P.O. Box 1541, Santa Rosa, Calif. 95405

[21] Appl. No.: 72,070

[22] Filed: Sep. 4, 1979

[51] Int. Cl.[3] ..... A41H 37/10

[52] U.S. Cl. ..... 227/15; 227/38; 227/61; 29/809

[58] Field of Search ..... 29/809; 227/15, 18, 227/38, 51, 60, 95

[56] References Cited

U.S. PATENT DOCUMENTS

| | | | |
|---|---|---|---|
| 199,503 | 1/1878 | Bray | 227/15 |
| 393,813 | 12/1888 | Bray et al. | 227/15 |
| 1,646,072 | 10/1927 | Stimpson | 227/15 |
| 2,097,248 | 10/1937 | Havener | 227/15 |
| 3,995,359 | 12/1976 | Randolph | 29/809 |
| 4,059,889 | 11/1977 | Randolph et al. | 29/809 X |

*Primary Examiner*—Paul A. Bell

*Attorney, Agent, or Firm*—Alvin E. Hendricson

[57] ABSTRACT

A machine for inserting quilting or tufting buttons of the type shown in U.S. Pat. No. 3,701,174, has male and female button drive mechanisms similar to those shown in U.S. Pat. No. 4,059,889, driven by a foot powered lever arrangement for rapidly tufting a pad or the like.

2 Claims, 7 Drawing Figures

96
27
-2-
11
26
46
48
31
106
47
13
53
12
21
22
24
23
19
-3-
28
93
91
92
16
-3-
49
29
44
18
43
42
41
66
39
52
38
36
51
37
-2-
14

96
27
46
48
98
97
12
21
71
72
87
73
76
74
83
81
-4-
-4-
17
18
61
63
62
61
62
63
64
43
66
81
83
17
37
36
18

FOOT POWERED TUFTING MACHINE

BACKGROUND OF INVENTION

Quilting or tufting of pads, mattresses and the like incorporate the extension of a tie through the pad, for example, in order to compress the filler at the tie location. Many types of quilting ties or buttons have been developed for industrial use and a most successful button is shown in U.S. Pat. No. 3,701,174. Quilting machines for rapid insertion of such buttons are shown in U.S. Pats. No. 3,995,359 and No. 4,059,889. Relevant prior art patents are cited in the foregoing patents.

While the very high speed semi-automatic operation of the above-noted machines is very advantageous for large high volume operations, it has been found that many low volume or custom tufting or quilting operations can be served with a less complicated machine. The present invention provides a simple inexpensive tufting machine operated by foot power.

SUMMARY OF INVENTION

The tufting machine of this invention includes male and female button drive mechanisms which are moveable axially toward and away from each other with a work table disposed therebetween for holding a pad of the like to be tufted or quilted. The female button drive mechanism includes a carriage mounted in vertical tracks beneath the work table and has a spring-loaded retractable needle extending upwardly therefrom for receiving a hollow female button part to be driven through a pad. The male button drive mechanism includes an axial drive shaft aligned with the above-noted needle above the work table and adapted to be moved downwardly to strike a male button part disposed on moveable support plates for driving the male button part into the aligned female button part piercing the pad as the needle is retracted to lock the button parts together through the pad.

The drive mechanisms noted above are moved by an actuator including a pivotally-mounted foot lever having an upright extension pivotally linked to a pivotally-mounted arm engaging the moveable carriage. A drive link in this connection rotates during lever actuation to thus move the carriage only slightly during the latter part of lever movement for retracting the needle. A spring-loaded pivot arm engaging the drive shaft of the male button drive mechanism has a depending drive rod engaged by the foot lever during the latter part of movement thereof to move the drive shaft for forcing a male button part through a female button part piercing a pad to complete a single tufting operation. Spring loading returns the foot lever and thus the carriage to normal or retracted position. Timed needle retraction results from spring release during final upward carriage movement as by a pawl engaging a fixed stop and the needle is reextended during carriage return as by a fixed stop engaging same.

The tufting machine hereof is quite simple in structure and easily operated so as to commend it to widespread use.

DESCRIPTION OF FIGURES

The present invention is illustrated with regard to a single preferred embodiment thereof in the accompanying drawings, wherein.

DESCRIPTION OF PREFERRED EMBODIMENT

Figure 1:
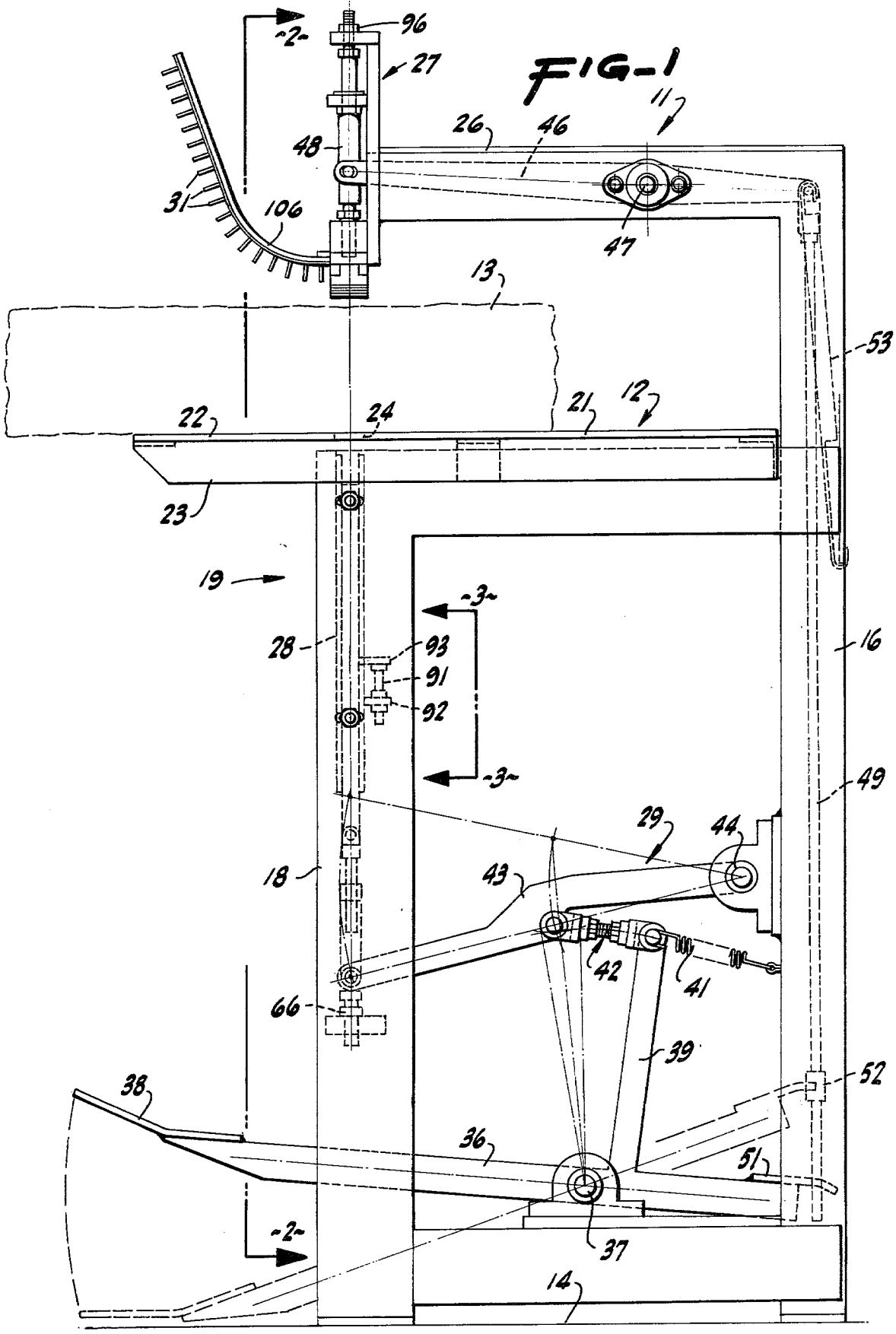
FIG. 1 is a side elevational view of a tufting machine in accordance with the present invention.

The present invention as illustrated in the accompanying drawings includes an upright stand 11, having a work table 12 disposed thereon at a convenient height for the placement of a pad or the like 13 to be tufted or quilted by the present invention. Normally, the tufting machine hereof is operated by an operator standing in upright position on a floor 14 supporting the stand 11, and thus the work table 12 may be disposed at a height of 3′ to 3½′ from the floor.

The stand 11 includes a rear upright column 16 and a pair of parallel-spaced apart front supports 17 and 18, suitably joined together and to the column by structural members as illustrated to form a rigid hollow rectangular unit 19. The work table 12 includes a fixed rigid rear horizontal portion 21 and a co-planar transparent front portion 22 preferably mounted on horizontal sides 23 slidably engaging the stand, so that the front portion of the table may be removed. A central opening or aperture 24 is formed at the juncture of the front and rear portions 21 and 22 of the work table in line with button feed mechanisms described below.

The rear column 16 of the stand extends upwardly from the work table into a fixed engagement with a top horizontal structural member 26 of the stand that mounts a male button drive mechanism 27 in spaced relation above the work table.

Beneath the work table 12 there is provided a female button drive mechanism 28 which is mounted between the front supports 17 and 18 in vertical alignment with the male button drive mechanism 27 through the aperture 24 in the work table. There is also provided foot powered actuating means 29 mounted on structural members of the stand below the work table. This actuating means is adapted to move the drive mechanisms 27 and 28 toward each other in timed sequence for forcing male and female quilting button portions into locking engagement with each other through a pad 13 disposed in the work table 12. These male and female button portions are shown in my U.S. Pat. No. 3,701,174 and are illustrated at 31 and 32, respectively, of FIG. 6 of the drawings hereof.

Reciprocation of the male and female button drive mechanisms is carried out by the actuating means 29 which includes a foot-operated lever or foot lever 36, pivotally mounted at 37 upon structural members at the bottom of the stand 11. The foot lever 36 extends forwardly of the stand with a foot plate 38 thereon in front of the front supports 17 and 18. A rigid upright member 39 extends perpendicularly upward from the foot lever 36 at a short distance behind the pivot point 37 and at the top thereof is connected by a tension spring 41 to the upright column 16 so as to normally pivot the foot lever 36 into the position illustrated in FIG. 1. A drive link 42 of adjustable length is pivotally connected at one end to the top of the upright 39 and at the other end is pivotally connected to the center of an arm 43 which, in turn, has one end pivotally mounted at 44 on the column 16, and at the other end, it is pivotally mounted to the bottom of the female button drive mechanism 28. The drive link 42, as shown in FIG. 1 will be seen to normally extend slightly upward from the top of the upright 39 and forwardly of the machine. The particular relationship of elements of this actuating means are further described below in connection with operation of the present invention.

The actuating means 29 further includes an upper pivot arm 46 pivotally mounted at 47 in or on the top horizontal structural member 26 of the stand. Pivot arm 46 is pivotally connected at the forward end thereof to a drive shaft 48 of the male button drive mechanism 27. The pivot arm 46 will be seen in FIG. 1 of the drawings to be pivotally mounted at about two-thirds of the length thereof from the forward end of the arm and at the rear end of the arm 46, it is pivotally mounted to a depending drive rod 49 disposed in the column 16 and extending downwardly into position for engagement by a forked extension 51 on the rear end of the foot lever 36. A lateral projection 52 is secured to the drive rod 49 in spaced relation to the lower end thereof for engagement by the forked end 51 of the foot lever, so during the latter part of a pivoting operation of the foot lever the drive rod will be engaged and forced upwardly to pivot the pivot arm 46. A tension spring 53 is connected between the rear end of the pivot arm 46 and the column 16 beneath the pivot arm, so as to normally pivot this arm 46 into the position illustrated in FIG. 1 of the drawings.

Figures 2, 4:
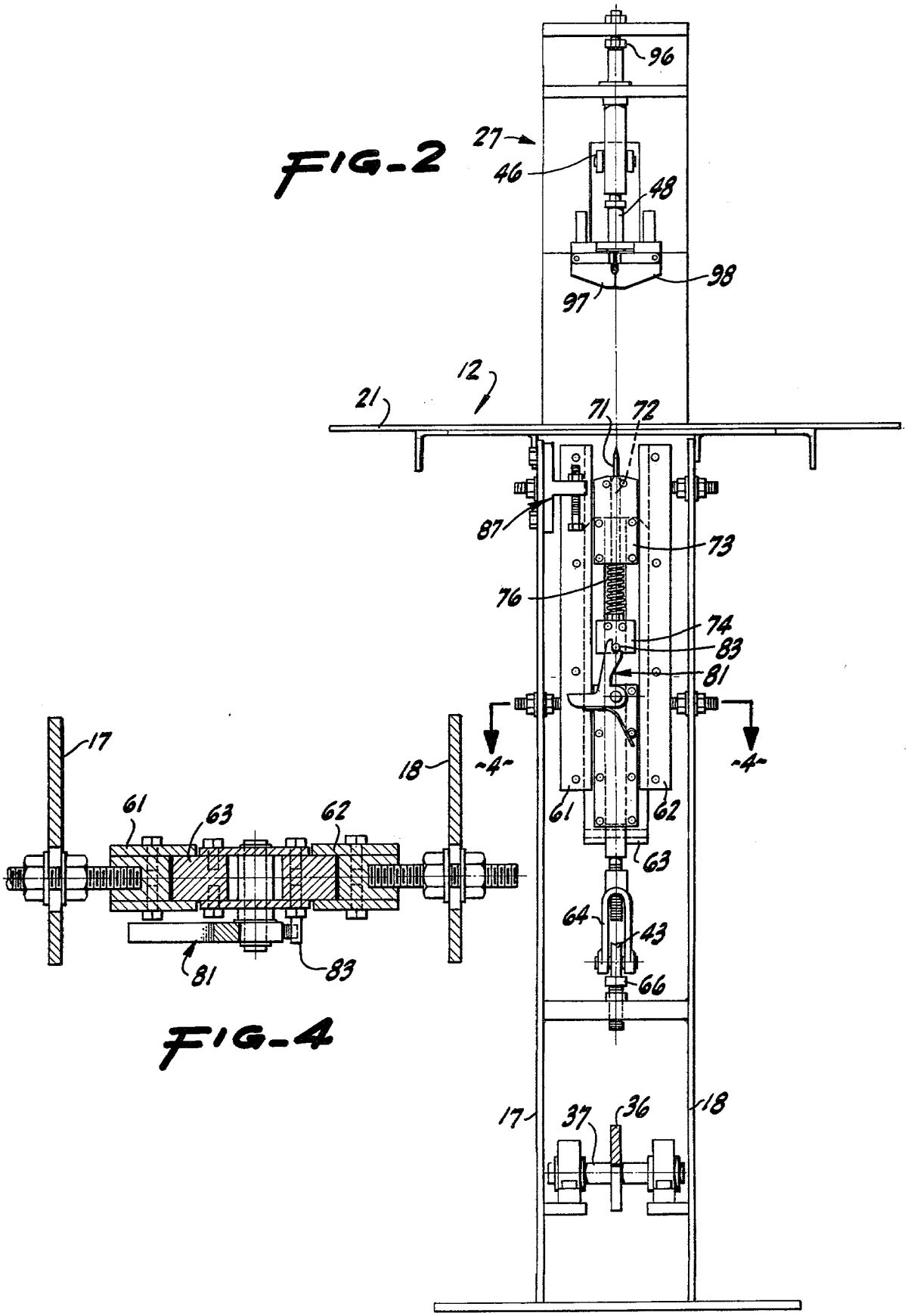
FIG. 2 is a front elevational view taken in the plane 2—2 of FIG. 1.
FIG. 4 is an enlarged transverse sectional view taken in the plane 4—4 of FIG. 3.

The female button drive mechanism 28 disposed beneath the table 12 is adapted to drive a female button portion 32 through a pad 13 to be tufted and to this end the mechanism 28 includes a pair of vertical parallel spaced-apart tracks 61 and 62 mounted between the upright supports 17 and 18 as by adjusting bolts as illustrated in FIGS. 2 and 4. A carriage 63 is disposed between the tracks 61 and 62 for movement longitudinally thereof, and at the bottom of the carriage there is provided a connection to a clevis 64 pinned to the outer end of the pivotally-mounted actuator arm 43. An adjustable stop 66 is mounted on a cross member between the supports 17 and 18 beneath the outer end of the actuator arm 43 for limiting downward movement of the carriage 63.

At the upper end of the carriage 63 there is provided a sharpened needle 71 extending upwardly from a vertical needle shaft 72 slidably disposed in a bore through a needle guide 73 secured to the carriage 63. The lower end of the needle shaft 72 is mounted on a needle block 74 slidably disposed on or in the carriage 63 for movement longitudinally thereof, and a spring 76 is compressed between the underside of the needle guide 73 and the block 74 so as to urge the needle downwardly into the needle guide. Control over the motion of the needle 71 is herein provided by a pawl 81 pivotally mounted on the carriage 63, and having somewhat of a reversed L shape with the pivotal mounting thereof adjacent the junction of the vertical and horizontal portions of the pawl. The upper right corner of the pawl 81 is relieved to form a shoulder 82 disposed to engage a pin 83 extending forwardly from the needle block 74.

A leaf spring 84 secured to the underside of the pawl 81 extends into engagement with a projection 86 on the carriage for urging the pawl to rotate in clockwise direction, i.e. to place the shoulder 82 thereof beneath the pin 83. The pawl 81 is adapted to be rotated in a counter-clockwise direction from the normal position illustrated in FIGS. 1 and 6, for example, by engagement of the horizontal portion of the pawl with an adjustable stop 87 mounted on a bracket 88 secured to the upright 17. As the carriage 63 is moved upwardly in the tracks 61 and 62, the pawl 81 will engage the stop 87 to pivot the pawl and thus move the shoulder 82 out from under the needle block pin 83. The needle block 74 will thus be forced to slide downwardly in the carriage 63 by the compression spring 76 and consequently, the needle 71 will be retracted into the fixed needle guide 73. In normal position of the needle block 74, as illustrated in FIG. 2, for example, the needle 71 is extended from the top of the needle block 74 a distance slightly greater than the height of a female button portion 32. The diameter of the needle 71 is made slightly smaller than the diameter of the upper opening through the female button portion 32, so that the button portion may be readily inserted onto the needle with the needle point extending upwardly from the button portion. This arrangement then provides for driving of the needle and female button portion through a pad or the like 13, as further described below.

Provision is also made for recocking the pawl 81, i.e. returning same to the position of FIG. 1 from the pivoted position described above. Such means include an adjustable stop 91 secured to a crosspiece 92 on the back side of the carriage 63 and positioned to engage a second projection or pin 93 on the back side of the needle block 74. The stop 91 is positioned so as to engage the needle block pin 93 when the carriage is retracted or moved downwardly in the tracks toward the position of FIG. 1, i.e. the lowermost position of the carriage. This then causes the travel of the needle block to be arrested while the carriage is still moving downwardly so as to compress the spring 76. At the bottom of the carriage travel the needle block 72 is disposed upwardly sufficiently for the pawl 81 to be pivoted by the leaf spring 84 thereof into normal position wherein the pawl shoulder 82 rests beneath the needle block pin 83. As the carriage continues to move downwardly and the needle block travel is arrested, the needle 71 will emerge from the top of the needle guide, and in the lowermost position of the carriage 63, the needle is disposed beneath the work table 12, again as illustrated in FIG. 1. In this position the tufting machine is ready to commence tufting operations.

Figure 6:
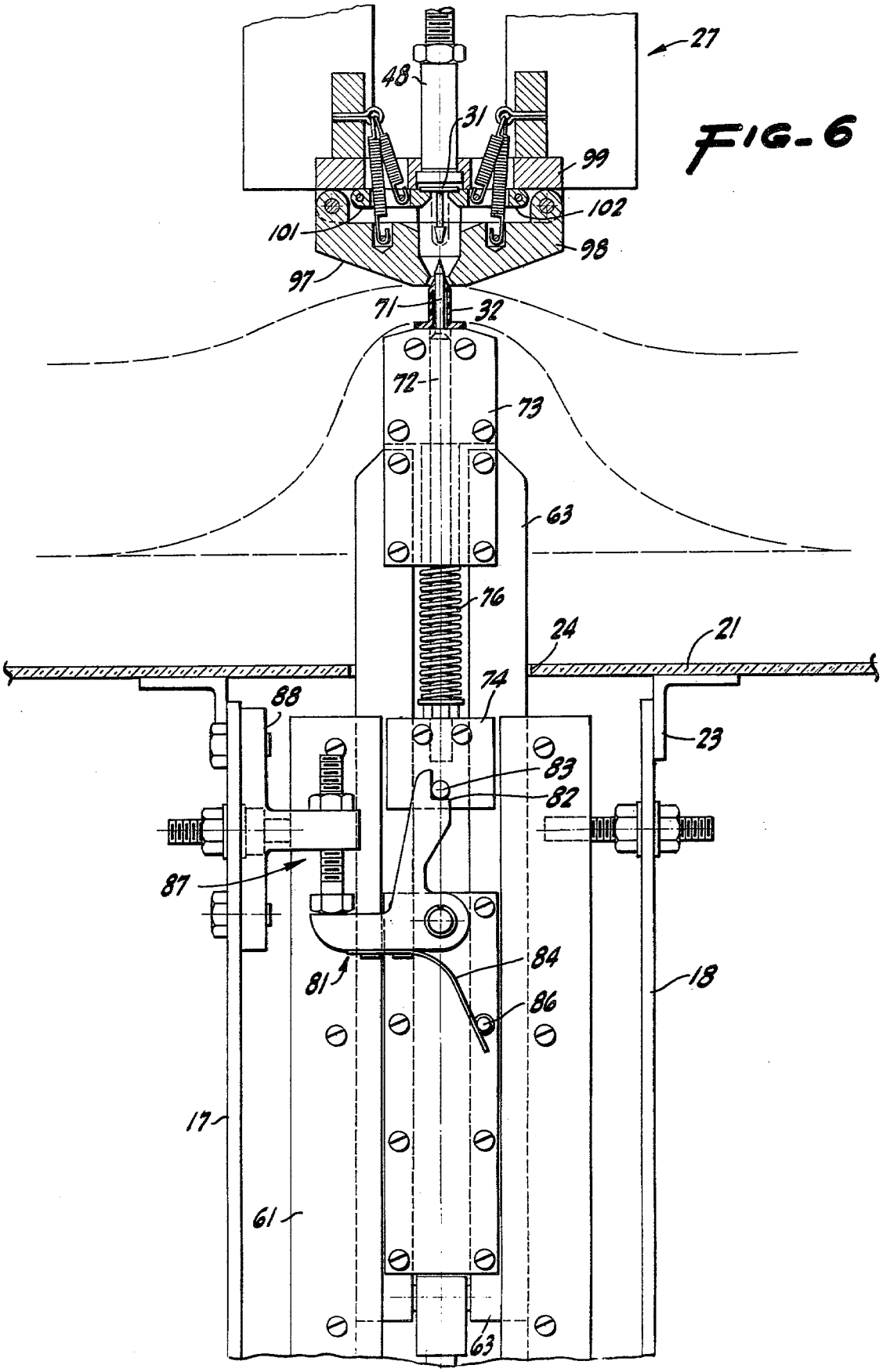
FIGS. 6 and 7 are partial front elevational views of the button drive mechanism at successive stages of the tufting operation performed by the present invention.
Figure 7:
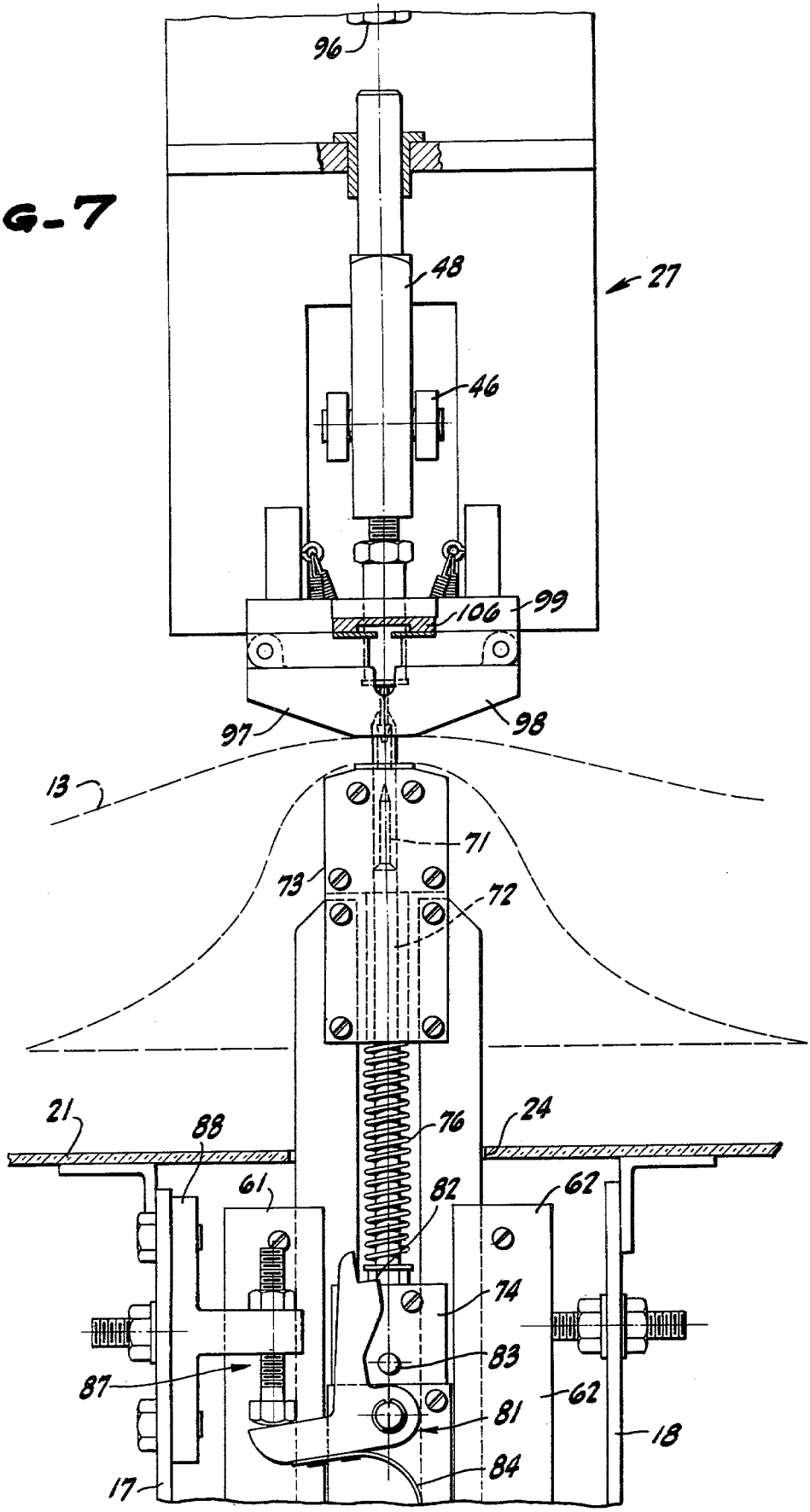

Considering now the male button drive mechanism 27 and referring particularly to FIGS. 1, 6 and 7, it will be seen that the vertical drive shaft or rod 48 which is adapted to be moved by the pivot arm 46 is aligned to engage on adjustable stop 96 above the upper end of the shaft 48 to limit movement of the latter away from the work table 12. A pair of jaws 97 and 98 are pivotably mounted beneath a block 99 and are spring loaded to normally maintain a closed position, as illustrated in the drawings. A pair of pivotally-mounted support plates 101 and 102 are disposed in the block 99 with adjacent edges defining a circular opening having a diameter slightly less than the flanged end of a male button part 31. The upper edge of this opening is bevelled, and a slot is formed from the front side of the plates 101 and 102 into the aperture for movement of a male button part across the top of the plates into alignment with the aperture. The drive shaft 48 is aligned with this aperture above same and the support plates 101 and 102 are pivotally mounted and spring loaded to normally maintain a horizontal position supporting a male button part as shown in FIG. 6, but are pivotally moveable when the shaft 48 forces the male button part downwardly.

Male button parts 31 may be automatically fed to the male button drive mechanism by means of a track 106 secured to the front of the block 99 and extending forwardly and upwardly therefrom, as shown in FIG. 1. The track 106 has a reentrant slotted underside dimensioned to receive the flanged ends of the male button parts so that a substantial number of these elements may be loaded onto the track which aligns with the slot between the pivot support plates 101 and 102. The lead button in the track 106 is urged onto the pivotal support plates 101 and 102 of the drive mechanism with the shank depending through the opening between these plates. In this position, as illustrated in FIG. 6, the male button part is ready to be driven by the drive mechanism 27. It is also noted that the jaws 97 and 98 have a double tapered central opening therebetween to accommodate the female button part and also passage of the male button part shank, as further described below.

Figure 5:
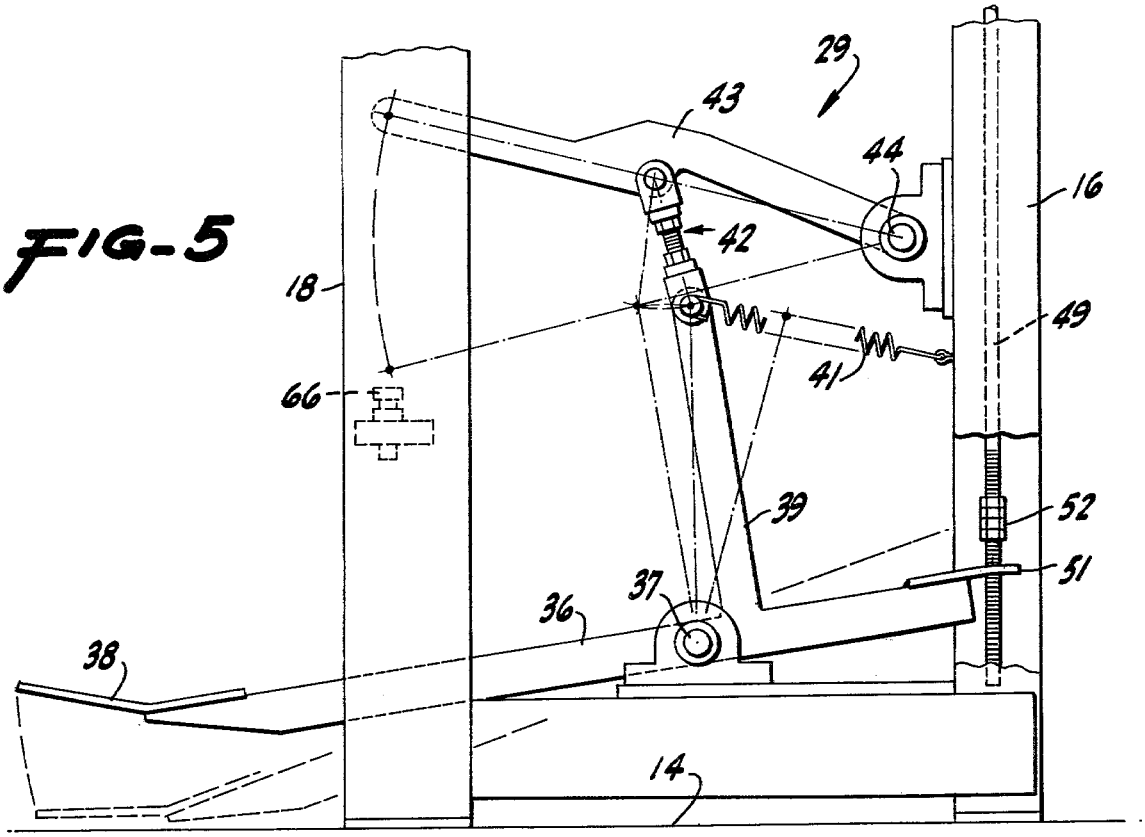
FIG. 5 is a partial side elevational view showing the actuating mechanism in an intermediate displaced position.
Figure 3:
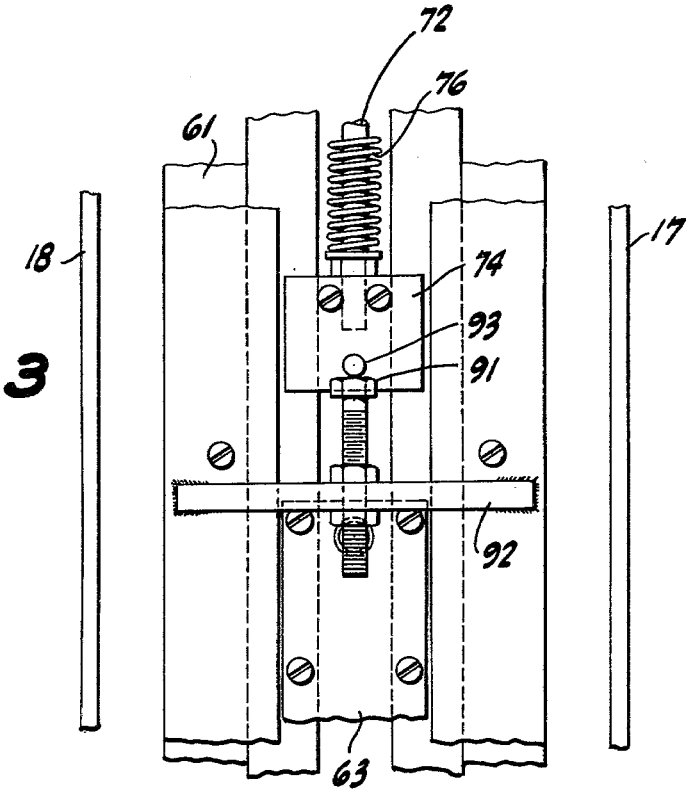
FIG. 3 is an enlarged partial elevational view taken in the plane 3—3 of FIG. 1.

The foot powered tufting machine of the present invention has been described above in connection with the accompanying drawings, and there follows a description of the sequence of operation. With the machine in the position illustrated in FIGS. 1 and 2, an operator places a female button part 32 on the needle 71 through the aperture 24, and the machine is then ready for a tufting operation. The operator places a pad or the like 13 on the work table 12 and aligns the pad so that the desired tufting location is vertically aligned with the male and female button drive mechanisms. The operator then holds the pad in position and steps on the foot plate 38 to pivot the foot lever 36. As the lever 36 commences to pivot, the arm 43 will be pivoted upwardly via the upright 39 and drive link 42. The arm 43 is pivotally connected by the clevis 64 to the female button drive mechanism carriage 63 which is consequently driven upwardly in the tracks 61 and 62. Reference is made to FIG. 5 wherein the lever 36 is shown pivoted to an intermediate position wherein the carriage 63 has been moved upwardly to the position of FIG. 6. It will be seen that as the carriage 63 is moved upwardly, the upper end or needle guide 73 thereof engages the underside of the pad 13 to compress same beneath the jaws 97 and 98 and thence to drive the needle 71 and female button part thereabout through the pad, also as shown in FIG. 6. During this portion of movement of the actuator, the drive link 42 will be seen to have been pivoted almost into alignment with the upright 39 and it is also noted that the fork 51 on the rear end of the lever 36 has merely moved upwardly along the drive rod 49.

As the operator continues to depress the foot plate 38 from the position of FIG. 5, the drive link 42 will be pivoted through longitudinal alignment with the upright 39 on the lever 36 so as to only slightly displace the carriage 63 upwardly. This slight upward displacement of the carriage causes the pawl 81 to be pivoted counter-clockwise by engagement of the horizontal portion of the pawl with the stop 87 and thus the shoulder 82 on the pawl moves out from under the pin 83 on the needle block 74. The spring 76 thus rapidly drives the needle block 74 downwardly on the carriage 63 to retract the needle 71 into the needle guide 73. As the lever arm 36 is further pivoted, the forked end 51 thereof engages the projection 52 on the drive rod 49 and pivots the upper arm 46 about the pivot point 47 thereof. The drive shaft 48 of the male button drive mechanism is thus driven downwardly from the position of FIG. 6 into the position of FIG. 7. As the drive shaft 48 is driven downwardly, it engages the flanged end of the male button part 31 forcing the pivotally mounted support plates 101 and 102 to swing outwardly as the male button part is forced downwardly and into the female button part 32. The expanded lower end of the male button part shank is forced through the restricted upper opening in the female button part 32, so as to lock the button parts together in extension through the pad 13. It will be seen that this actuation of the male button drive mechanism by the lever arm 36 does not materially move the female button drive mechanism because of the particular link arrangement connecting the lever arm 36 and pivot arm 43 of the actuator.

During depression of the foot plate 38, the spring 41 will be seen to be extended and as soon as pressure is removed from the foot plate 38, this spring 41 will return the actuator to normal position by pivoting the lever arm 36 upwardly into the position of FIG. 1. As the lever arm 36 is pivoted back to original position, the spring 53 pivots the upper arm 46 back into original position. The male and female button drive mechanisms are then retracted into original position and the tufting machine is ready for another operation by inserting a female part in the needle 71 and repeating the foregoing sequence of events. Gravity and normal vibration of the machine has been found to be sufficient to cause successive male button parts to slide into the male button drive mechanisms from the the track 26.

Of particular note during the tufting operation is the movement of the drive link 42 which will be seen to rotate from the position of FIG. 1 through the position of FIG. 5 to the ultimate position indicated by the dashed line in FIG. 5. This causes the arm 43 to be rapidly pivoted during initial movement of the lever arm 36 but to be only slightly moved during the remainder of the pivoting of the arm 36. The foregoing provides for proper positioning of the female drive mechanism wherein the needle and female button part are driven through the pad and subsequent maintenance of this female drive mechanism in substantially the same raised position while the needle is retracted so that the male button part is then capable of being driven into the female button part. As the carriage of the female button drive mechanism is lowered or returned to original position, the fixed stop 91 on the back of the tracks 61 and 62 engages the pin or projection 93 on the back of the needle block so as to recompress the spring 76 and allow the pawl 81 to be pivoted back into holding engagement with the needle block whereby the system is "recocked" and ready for the next tufting operation.

The tufting machine of the present invention is relatively simple and consequently inexpensive as compared to high speed automated quilting machines. Various portions of the present invention are similar to or the same as portions of more complicated machines described in the above-noted patents, and the same high quality quilting operation is attainable with the present machine as with more complicated machines. The simple highly effective drive mechanism or actuating means of the present invention serves not only to appropriately drive the male and female button drive means, but also to automatically time a sequence of operation, so that an operator need only insert a female button part, position the pad, and step on the foot plate in order to complete a tufting operation.

Although the present invention has been described above with respect to a single preferred embodiment thereof, it will be appreciated by those skilled in the art that numerous modifications and variations are possible within the spirit and scope of the present invention and thus it is not intended to limit the invention to the details of illustration or precise terms of description. f

What is claimed is:

1. A foot powered tufting machine adapted to engage male and female button parts through a pad or the like comprising a female button drive mechanism including a retractable needle adapted to extend through a female button part and a moveable carriage carrying said needle, said female button mechanism including a pair of vertical tracks mounting said carriage in slidable relation therebetween a needle block slidably disposed on said carriage and mounting said needle in extension upwardly from the carriage through an apertured needle guide, a spring urging said needle block downwardly on said carriage to retract said needle into said guide, a pawl pivotally mounted on said carriage for normal engagement with said needle block to hold same against said spring, and a stop secured to said track in position for engagement by said pawl adjacent the upper end of carriage travel to pivot the pawl and release the needle block for retracting the needle into said guide after the needle and a female button part are driven through a pad to be quilted so that a male button part may be driven into the female button part, a male button drive machanism including moveable button support means and a drive shaft for engaging a male button part disposed on said support means, and actuating means including a pivotally mounted foot operated lever linked to a pivotally mounted arm coupled to said moveable carriage and a second pivotally mounted arm engaging said drive shaft and having a drive rod extending therefrom for operative engagement by said foot operated lever at the terminal portion of the pivoting movement of said lever, said actuating means including a drive link pivotally connected to said arm pivotally connected to an upright on said foot operated lever and disposed to be rotated as said lever is pivoted for substantial movement of said carriage during initial lever movement and minimal movement of said carriage during terminal lever movement whereby pivoting of said lever first moves said female button drive mechanism and subsequently moves said male button drive mechanism.

2. The machine of claim 1 further defined by said foot lever having a forked end disposed about said drive rod and said drive rod having a lateral projection thereon in spaced relation to the lower end thereof for engagement by said forked end to move the rod upwardly during the later part of the pivotal lever movement.

* * * * *